US005136822A

United States Patent [19]

Blum

[11] Patent Number: 5,136,822

[45] Date of Patent: Aug. 11, 1992

[54] PREFABRICATED BUILDING ELEMENTS

[76] Inventor: Alan L. Blum, 4820 Alpine Pl., Las Vegas, Nev. 89107

[21] Appl. No.: 413,548

[22] Filed: Sep. 27, 1989

[51] Int. Cl.[5] ..... E04H 1/00

[52] U.S. Cl. ..... 52/241; 52/281

[58] Field of Search ..... 52/238.1, 240, 241, 52/242, 243, 281, 282

[56] References Cited

U.S. PATENT DOCUMENTS

| | | | |
|---|---|---|---|
| 2,065,433 | 12/1936 | Dercum et al. | 52/281 X |
| 2,311,951 | 2/1943 | Marshall | 52/243 |
| 2,733,785 | 2/1956 | Beatty | 52/240 X |
| 3,685,227 | 8/1972 | Grisard et al. | 52/242 |
| 3,755,982 | 4/1973 | Schmidt | 52/295 |
| 3,810,337 | 5/1974 | Pollard | 52/223 |
| 3,877,191 | 4/1975 | Munsey | 52/632 |
| 3,969,852 | 7/1976 | Krings | 52/155 |
| 4,133,153 | 1/1979 | Hage | 52/242 X |
| 4,249,354 | 2/1981 | Wynn | 52/688 X |
| 4,288,962 | 9/1981 | Kavanaugh | 52/743 |
| 4,295,304 | 10/1981 | Kim | 52/90 |
| 4,313,287 | 2/1982 | Romig, Jr. | 52/223 |
| 4,398,377 | 8/1983 | Romig, Jr. | 52/223 |
| 4,494,348 | 1/1985 | Kastelic | 52/588 |
| 4,601,137 | 7/1986 | Bates | 52/242 X |
| 4,712,352 | 12/1987 | Low | 52/809 |

FOREIGN PATENT DOCUMENTS 651525 10/1962 Canada .

*Primary Examiner*—Henry E. Raduazo

*Attorney, Agent, or Firm*—Quirk, Tratos & Roethel

[57] ABSTRACT

The prefabricated building element of the present invention is manufactured in a variety of modules. All of the exterior modules have a surface designed to be exposed to the outside environment and fabricated from exterior building materials typically used in the industry. The inside surface is fabricated from interior building materials typically used in the industry. All of the interior modules have both surfaces made from interior building materials.

Sheet metal top and bottom channel plates space the inside and outside wall surfaces apart and the inner cavity is filled with insulating material. The lateral end of each building element is closed by a rectangular sheet metal interior support column which also functions as the means to connect each building element to the adjoining building element. Each module has one interior support column per module. A sheet metal vertical attachment member midway along each building element provides additional means holding the wall elements of each module together, but these vertical attachment members do not provide structural support.

70 Claims, 11 Drawing Sheets

PREFABRICATED BUILDING ELEMENTS

BACKGROUND OF THE INVENTION

This invention relates to prefabricated building elements and more particularly to prefabricated building elements having spaced end support columns formed from sheet metal with the interior cavity of the support column filled with insulating material.

Buildings have been typically constructed by erecting on the building site a wooden or metal frame on a concrete slab or other appropriate foundation. The exterior surface of the building can be brick, stucco or other conventional exterior materials. The interior surfaces are typically wallboard, sheetrock or plaster. It is also quite conventional to include any insulating material, such as fiberglass, in the cavity between the exterior surface and the interior surface of the wall of the building.

Another conventional method of building construction involves using prefabricated building elements. Various modules are fabricated in a manufacturing plant and then transplanted to the building site. Based on the design of the building, the architect and contractor can determine the number and sizes of the various modules that are necessary to construct the building. The typical modules that are prefabricated include the exterior wall modules, the exterior door modules, the exterior window modules, the interior wall modules and the interior door modules.

The use of prefabricated building elements allows an entire subdivision of housing units or an entire office or commercial complex to be fabricated in a manufacturing plant and then shipped to the building site for assembly. This mass production technique helps minimize the cost of construction.

It is an object of the present invention to provide prefabricated building elements that are easy to manufacture and are also easy to assemble on the construction site.

It is a further object of the present invention to provide prefabricated building elements that can be manufactured as various modules, such as an exterior wall module, an exterior door module, an exterior window module, an interior wall module and an interior door module.

BRIEF SUMMARY OF THE INVENTION

The prefabricated building element of the present invention is manufactured in a variety of modules. All of the exterior modules have a surface designed to be exposed to the outside environment and fabricated from stucco, masonite, wood siding, brick or other exterior building materials typically used in the industry. The inside surface of the exterior modules does not need the same level of weather and element protection that is needed by the outside surface. The inside surface therefore is fabricated from gypsum board, fiber cement or other interior building materials typically used in the industry. All of the interior modules have both surfaces made from interior building materials.

Sheet metal top and bottom channel plates space the inside and outside wall surfaces apart and the inner cavity is filled with insulating material. The insulating material is preferably an inorganic material, such as expanded polystyrene. Alternately, the insulating material can be extruded polystyrene, polyisocyanurate, polyurethane, fiberglass or other conventional insulating material typically used in the industry. It is also possible to utilize organic insulating material, such as organic insulating material sold under the trademark Celotex ® wallboard and other building materials.

The lateral end of each building element is closed by a rectangular sheet metal interior support column which also functions as the means to connect each building element to the adjoining building element. Each module has one interior support column per module. A vertical sheet metal attachment member midway along each building element provides additional means holding the wall elements of each module together, but these vertical attachment members do not provide structural support.

Each building module is fabricated in a factory including assembling the wall surfaces to the module and providing the insulation between the wall surfaces. Alternatively, the outside wall surface of the exterior modules can be added at the building site. Appropriate electoral wiring and junction boxes can be included during this factory fabrication. A plurality of the building modules are then assembled together on the construction site to form a building. Each building module is fastened to the floor of the building as well as to each adjoining building module. All interior and exterior walls of the building can be constructed using the appropriate building modules which are an exterior wall module, an exterior door module, an exterior window module, an interior wall module and an interior door module.

Other objects, features and advantages are set forth in the following detailed description of the preferred embodiments.

DETAILED DESCRIPTION OF THE PREFERRED EMBODIMENTS

Figure 1:
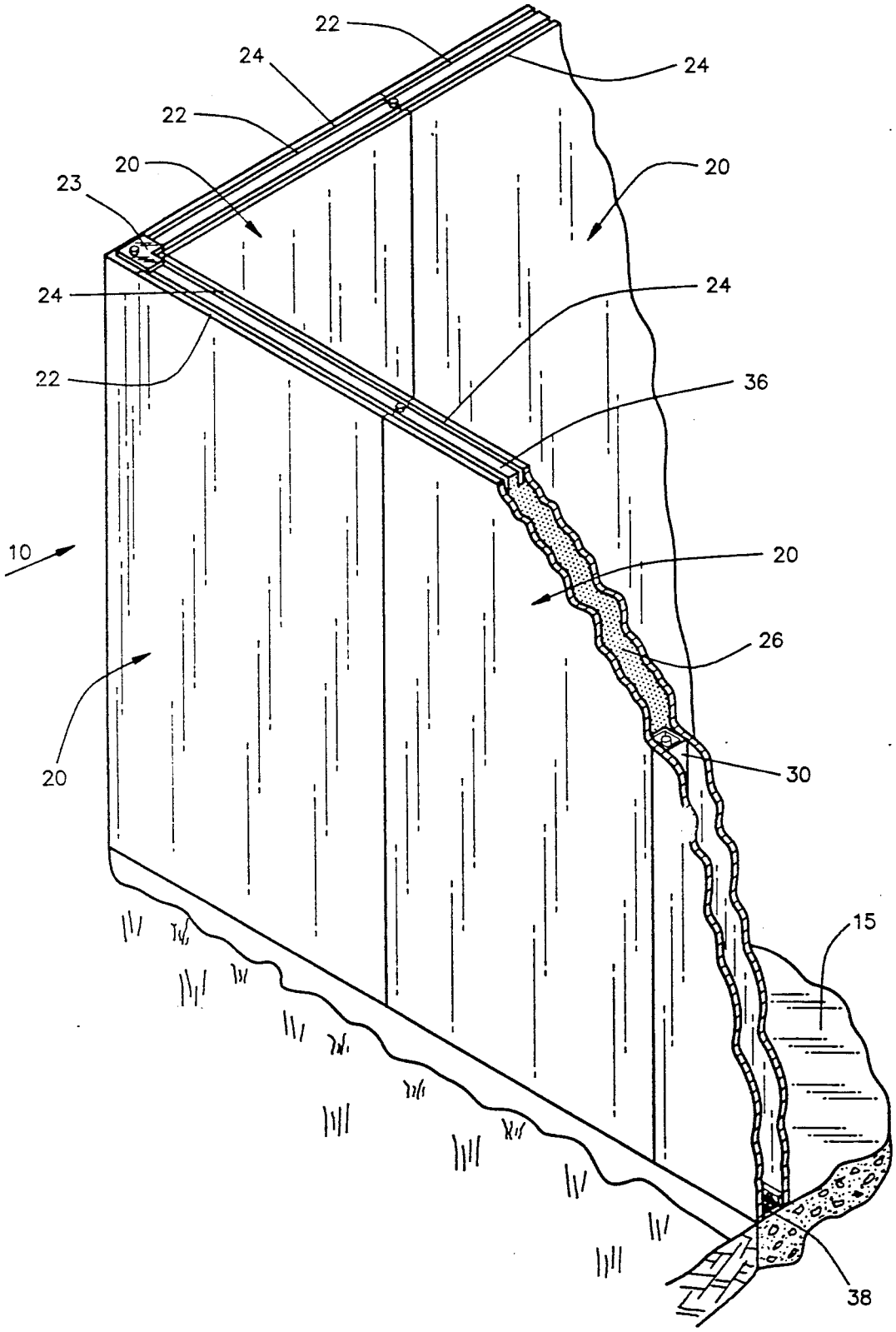
FIG. 1 is a perspective view of a wall structure formed from a plurality of the building elements of the present invention.

As shown in FIG. 1, a wall structure 10 is assembled from a plurality of building elements 20. The building element 20 is an exterior wall module in that it forms a portion of the exterior wall of the building but has no opening for either a door or a window. Each exterior wall module 20 is fastened to the building floor 15 which can be a conventional concrete floor, although other typical flooring material can also be used. The outside wall surface 22 can include a wire mesh over which is applied stucco while the inside wall surface 24 can be wallboard. Alternately, the outside wall surface can be made from stucco, masonite, wood siding, brick or other exterior building materials typically used in the industry. The inside surface can be fabricated from gypsum board, fiber cement or other interior building materials typically used in the industry.

A top channel plate 36 and a bottom channel plate 38 support the outside wall surface 22 and the inside wall surface 24 and provide for a cavity between the outside wall surface 22 and the inside wall surface 24, which cavity is filled with insulating material 26. The insulating material is preferably an inorganic material, such as expanded polystyrene. Alternatively, the insulating material can be extruded polystyrene, polyisocyanurate, polyurethane, fiberglass or other conventional insulating material typically used in the industry. It is also possible to utilize organic insulating material, such as Celotex ® wallboard and other building materials.

At one end of the building element 20, an interior support column 30 is provided to close one end of the building element 20 and to provide means for joining each building element 20 to the next adjoining building element 20.

Figure 2:
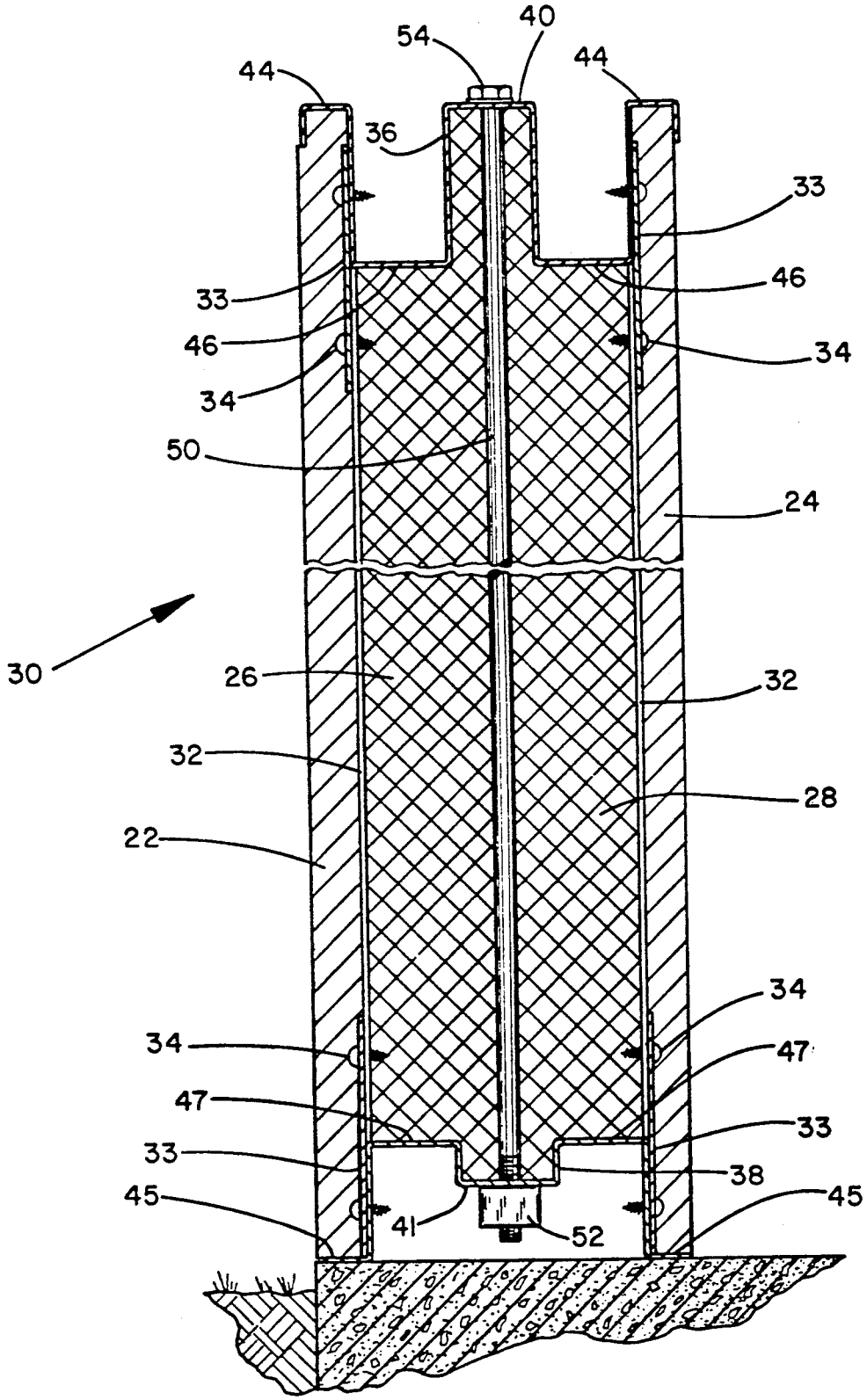
FIG. 2 is a section view of the building element of the present invention showing the interior support column.

As shown in FIGS. 1 and 2, the interior support column 30 is a hollow body having a generally rectangular crosssection and is preferably formed of sheet metal. The interior cavity of the support column 30 is also filled with styrofoam 26.

The interior support column 30 has four side walls 32 that form the interior cavity 28 and the overall height of the interior cavity 28 is slightly less than the height of the outside wall surface 22 and the inside wall surface 24 to accommodate the shape of the top and bottom channel plates. The bottom of the interior support column 30 rests on the bottom channel plate 38 and each side wall 32 is joined to the bottom channel plate 38 by means of an overlapping fastening plate 33 and fastening pins or screws 34. A tie rod 50 extends vertically down generally the center of the interior support column 30 and joins the top channel plate 36 and the bottom channel plate 38.

The top channel plate 36 is generally W-shaped with its central area 40 providing a support surface for the head 54 of the tie rod 50. The outer ends 44 of the top channel plate 36 are inverted U-shaped channels that overlap and support the upper end of the outside wall surface 22 and the inside wall surface 24. The intermediate portions of the top channel plate 36 are U-shaped channels 46 that provide lateral support for the outside wall surface 22 and the inside wall surface 24 as well as providing a mounting surface for the overlapping fastening plates 33.

The bottom channel plate 38 is generally inverted W-shaped with its central area 41 providing a support surface for the nut 52 that secures the end of the tie rod 50. The outer ends of the bottom channel plate 38 are flanges 45 that support the lower end of the outside wall surface 22 and the inside wall surface 24. The intermediate portions of the bottom channel plate 38 are inverted U-shaped channels 47 that provide lateral support for the outside wall surface 22 and the inside wall surface 24 as well as providing a mounting surface for the overlapping fastening plates 33.

As shown in FIG. 1, both the top channel plate 36 and the bottom channel plate 38 extend the entire length of the building element 20.

Figure 3:
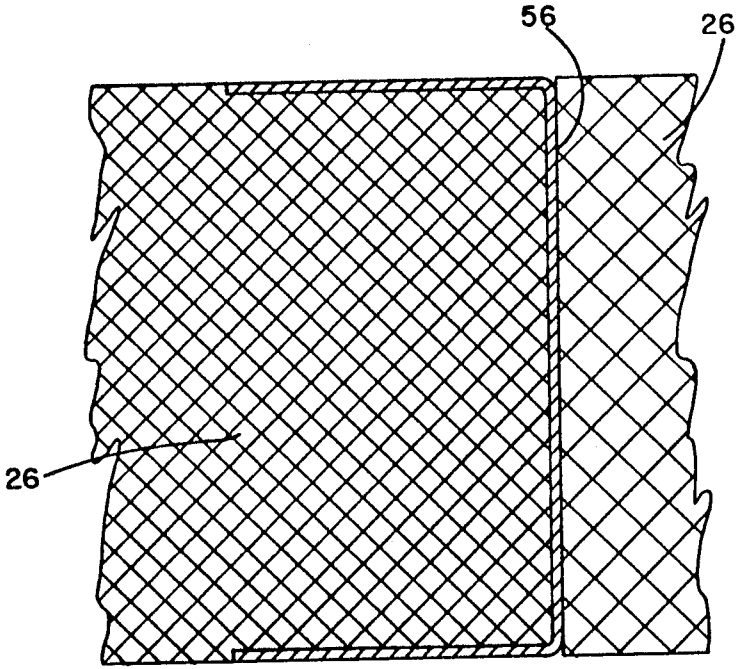
FIG. 3 is a section view of the building element of the present invention showing the vertical attachment member.

FIG. 3 shows a generally C-shaped vertical attachment member 56 which is located about midway along the length of building element 20. The lower end 58 (see FIG. 4) of the vertical attachment member 56 is slightly stepped out at 59 to allow the vertical attachment member 56 to overlap the U-shaped channel 47 of the bottom channel plate 38. The vertical attachment member 56 is attached to the U-shaped channel 47 by fastening pins or screws 34. The vertical attachment member 56 is used for joining the sheetrock or other exterior cladding material to the wall assembly.

Figure 4:
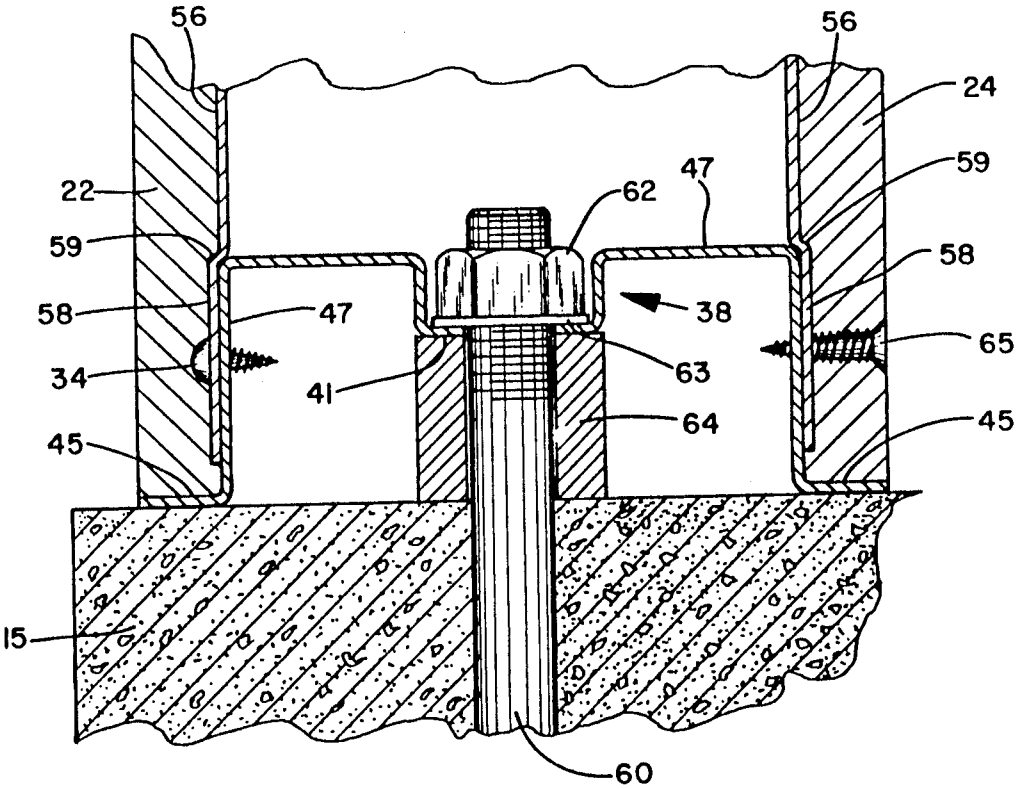
FIG. 4 is a section view showing the bottom channel member fastened to the floor of the building.

As also shown in FIG. 4, the bottom channel plate 38 is secured to the floor 15 of the building by a bolt 60, nut 62 and washer 63. A solid, preferably metal, bar 64 in the form of a cube underlies the central area 41 and provides support for the central area 41 of the bottom channel plate 38 when the bolt 60 is secured therethrough. An aperture is provided in both the solid bar 64 and the central area 41 to permit the bolt 60 to extend above the central area 41 to receive the nut 62 and washer 63. A screw 65 or other suitable securing means attaches the inside wall surface 24 to the vertical support member 56. The outside wall surface 22 is likewise secured.

Figure 5:
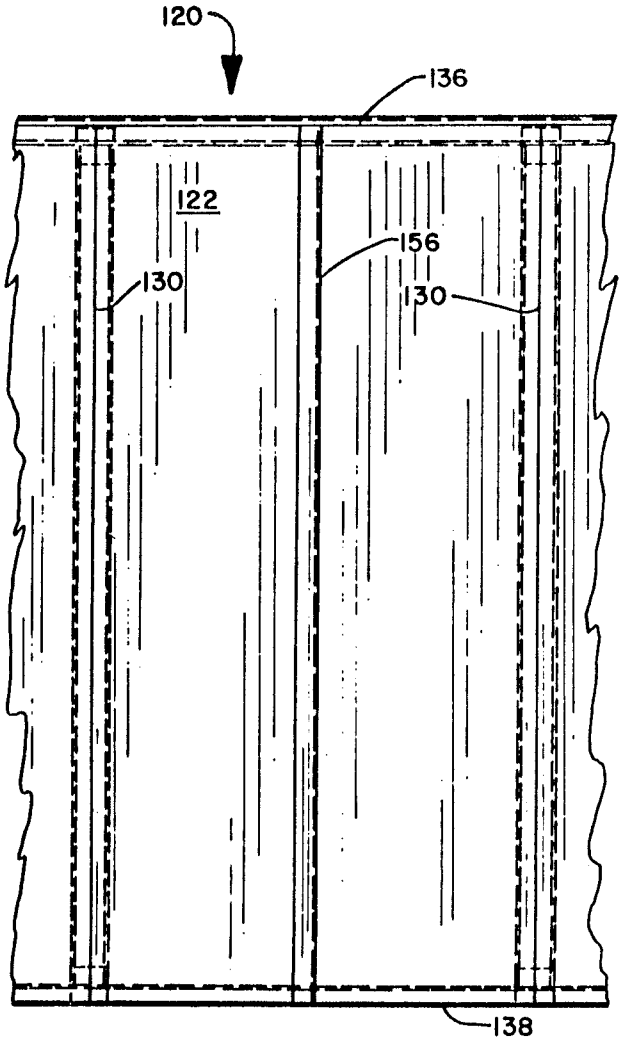
FIG. 5 is a front view of an exterior wall module of the building element of the present invention.

An exterior wall module 120 of the building element of the present invention is shown in FIG. 5. The bottom of the outside wall surface 122 rests on the bottom channel plate 138 (in the manner shown in detail in FIG. 2) and the top channel plate 136 rests on the top of the outside wall surface 124 (also shown in detail in FIG. 2). The interior wall surfaces (not shown) are configured in the manner shown in FIG. 2. A support column 130 (similar to support column 30 in FIGS. 1 and 2) is located at each lateral end of the exterior wall module 120. At the approximate midpoint along the length of the exterior wall module 120 there is provided a C-shaped vertical attachment member 156 (in the manner shown in detailed in FIG. 3) which provides attachment surfaces for joining the sheetrock or other exterior cladding to the assembly.

An exterior wall module 120 has no opening for doors or windows. One side wall surface of the exterior wall module is the exterior wall of the building while the opposite wall surface is on the interior of the building.

Figure 6:
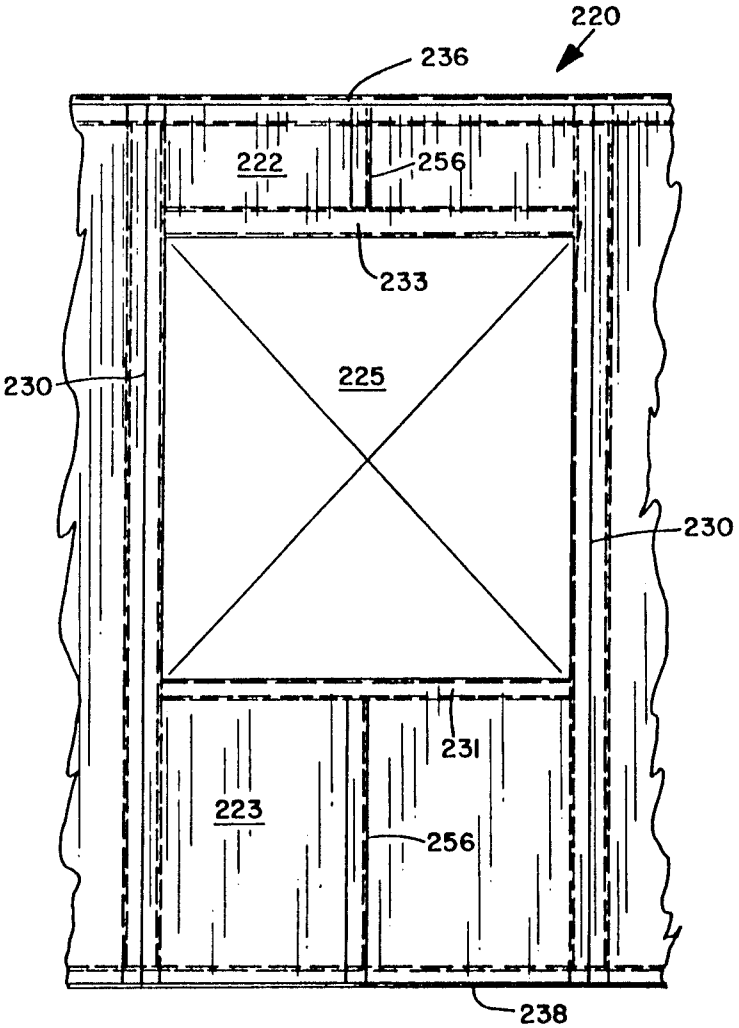
FIG. 6 is a front view of an exterior window module of the building element of the present invention.

FIG. 6 shows a front view of an exterior window module 220 of the present invention. Each lateral end of the exterior window module 220 is closed by an interior support column 230. The exterior wall surface comprises an upper exterior wall surface panel 222 and a lower exterior wall surface panel 223 separated by a space 225 into which a window can be installed.

The bottom of the lower exterior wall surface panel 223 rests on the bottom channel plate 238. A generally inverted U-shaped sheet metal channel 231 rests on the top of the lower exterior wall surface panel 223 and functions as the bottom support for the window to be installed. A C-shaped vertical attachment member 256 is provided approximately at the midpoint of the lower exterior wall surface panel for attaching the sheetrock or other cladding material to the assembly.

The upper exterior wall surface panel 222 is similarly positioned with the upper end of the window opening defined and supported by a generally U-shaped sheet metal channel 233. A C-shaped vertical attachment member 256 is provided approximately at the midpoint of the upper exterior wall surface panel 222 for attaching the sheetrock or other cladding material to the assembly. A top channel plate 236 is provided at the top of the exterior window module 220.

Figure 7:
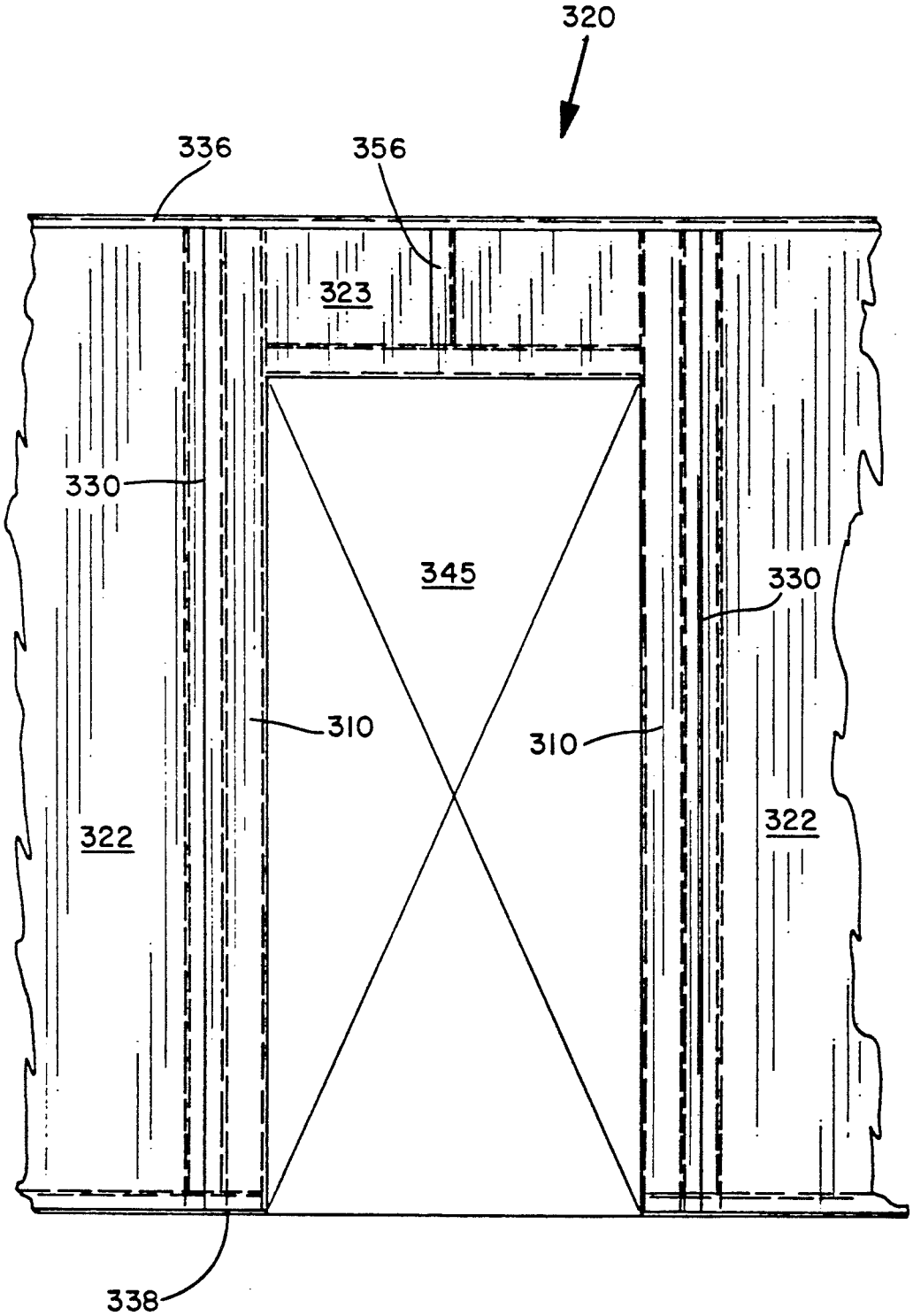
FIG. 7 is a front view of an exterior door module of the building element of the present invention.
Figure 8:
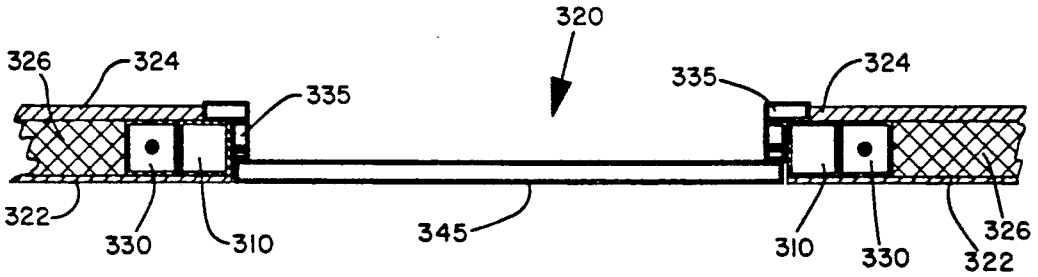
FIG. 8 is a top section view of an exterior door module of the present invention.

FIGS. 7 and 8 show the detail of an exterior door module of the present invention. The exterior door module 320 is fastened at each of its lateral ends to the interior support member 330 on the adjoining building element. A door frame support 310, which is rectangular in cross-section, fabricated from sheet metal and generally the height of the interior support member 330 is fastened to the interior support member 330 using any suitable fastening means, such as fastening pins. The interior cavity of the door frame support 310 is filled with insulating material. The outside walls surface 322 overlays the interior support member 330 and the door frame support 310. Similarly, the inside wall surface 324 overlays the interior support member 330 and the door frame support 310. The cavity between the inside wall surface 324 and the outside wall surface 322 is filled with insulating material 326. A conventional door frame 335 is attached to the door frame support 310 and a conventional exterior door 345 is hung on the door frame. The space between the top of the door 345 and the top channel plate 336 is closed with exterior wall material 323 which is fastened in place by using a C-shaped vertical attachment member 356. The space above the door 345 on the interior side is likewise closed.

Figure 9:
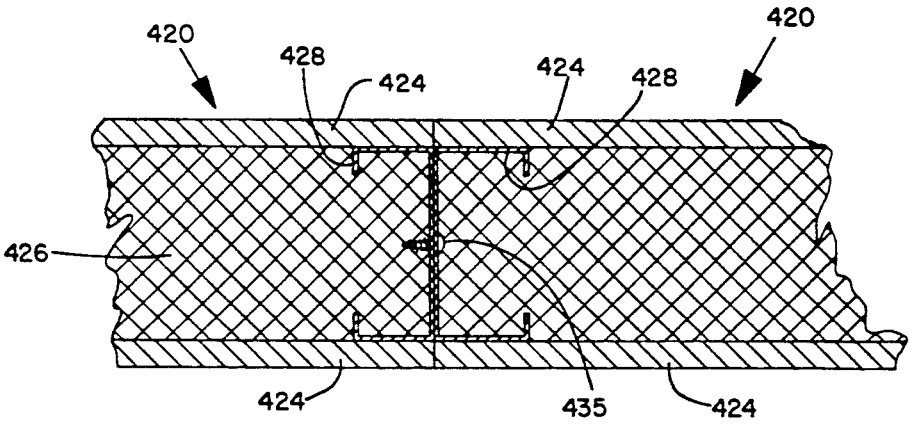
FIG. 9 is a section view of the joinder of two interior wall modules.

FIG. 9 depicts two interior wall modules 420 joined together. Because the interior wall modules are not load-bearing walls, it is not necessary that these modules be provided with the interior support column 30 that is used in the exterior modules. Each interior wall module 420 has two wall surfaces 424 and the interior cavity 426 is filled entirely or partially with insulating material. At each lateral end of the interior wall module, a generally C-shaped channel 428 is provided to close the lateral end of the interior cavity 426. A generally U-shaped channel plate (not shown, but similar to the top channel plate 36 and the bottom channel plate shown in FIGS. 1 and 2) closes the top edge and bottom edge of the interior wall module. During assembly of the building at the building site, adjoining interior wall modules are attached at their lateral ends by using suitable fastening means such as screws 435.

Figure 10:
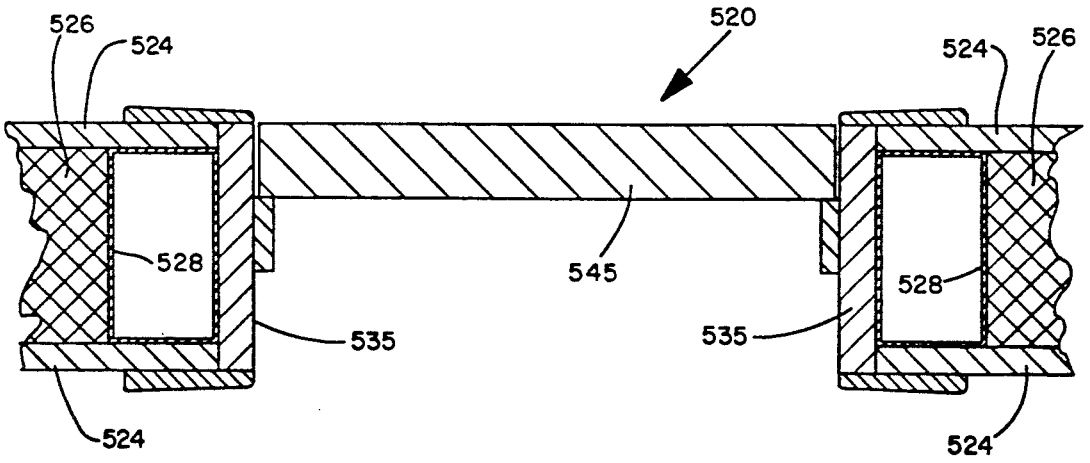
FIG. 10 is a top section view of an interior door module of the building element of the present invention.

An interior door module 520 is shown in section in FIG. 10. Each lateral end of the interior door module is a generally rectangular sheet metal member 528 whose interior cavity is filled with insulating material. The sheet metal member 528 provides as attachment surface for a conventional door frame 535 on which is hung a conventional interior door 545. The interior wall surfaces 524 are attached to the rectangular sheet metal member 528. The resulting interior cavity 526 between the interior wall surfaces 524 is filled entirely or partially with insulating material.

Figure 11:
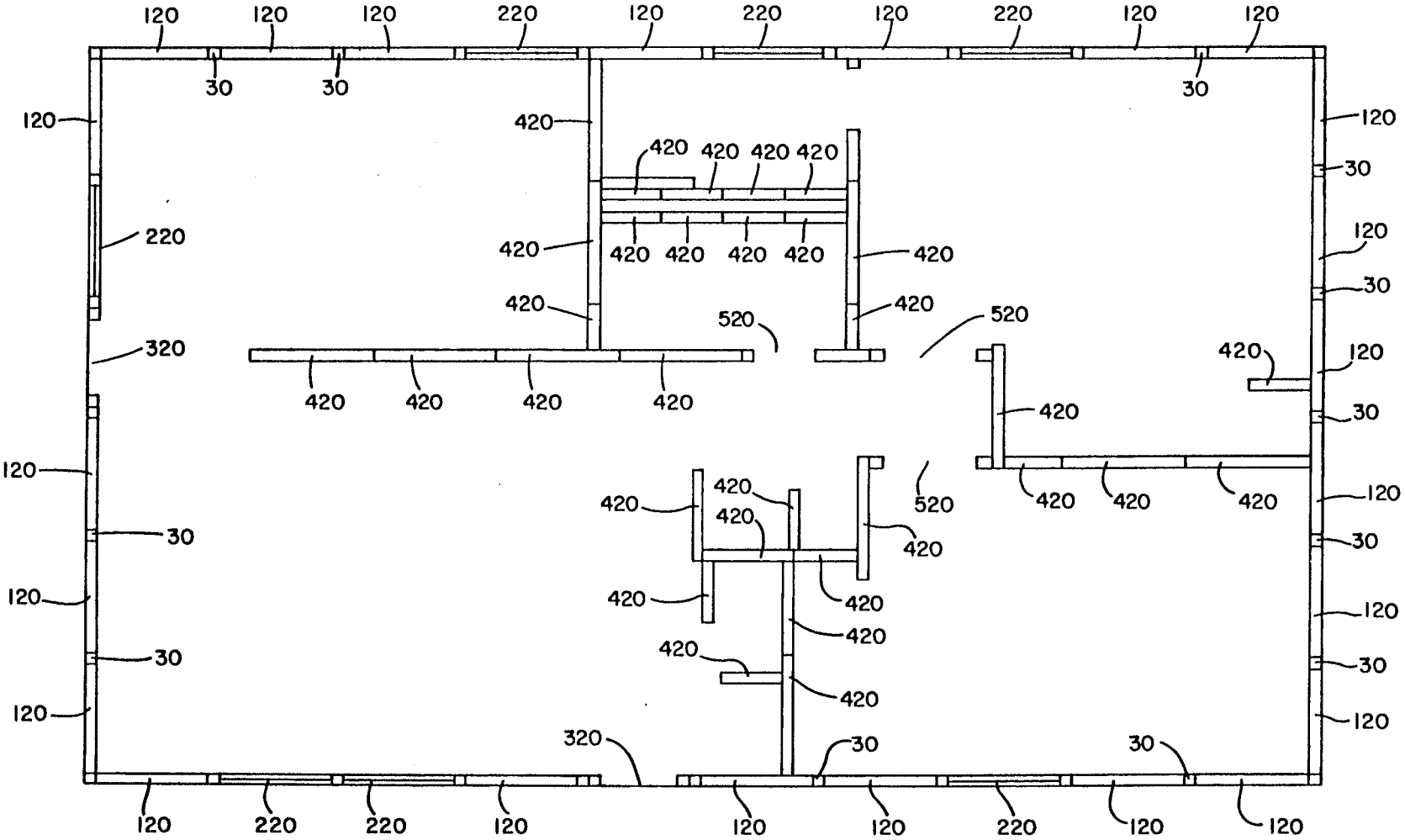
FIG. 11 is a schematic depiction of a typical building that can be constructed using the various modules of the building element of the present invention.

A typical building that can be constructed using the various modules of the building elements of the present invention is shown in FIG. 11. The exterior wall module 120 is used on the outer perimeter of the building. At the junction of two exterior wall modules 120, an interior support column 30 (as more fully shown in FIG. 2) is provided.

When a window is desired, the exterior window module 220 is used. The junction between the lateral end of an exterior window module 220 and the lateral end of an adjoining module utilizes the support column 230 shown in FIG. 6.

The exterior doors are provided using the exterior door module 320 shown in FIGS. 7 and 8. The junction between the lateral end of an exterior door module 320 and the lateral end of an adjoining member utilizes the interior support column 330 and the door frame support 310 shown in FIG. 8.

The interior of the building can be partitioned into rooms using the interior wall modules 420. At the locations where an interior door is desired, the interior door module 520 is utilized.

The assembly of a building using the building elements of the present invention will now be described. A bottom plate 38 of the appropriate length is bolted or otherwise fastened to the cement floor 15 of the building using the bolt 60, washer 63 and nut 62 arrangement shown in FIG. 4. Each building element 20 is placed seriatim next to the previously placed building element according to the order desired to provide for exterior walls, doors and windows and interior walls and doors at the appropriate locations. As each building element 20 is placed next to the adjoining building element, the vertical lateral adjoining edges are fastened together using appropriate fasteners, such as nails or screws.

The lower ends of the side walls 22 and 24 of each building element are connected to the bottom plate 38 using the overlapping fastening members 33 and the connecting screws 34 as shown in FIG. 2. The top channel plate 36 is next placed on top of the building elements and connected to the upper ends of the side walls 22 and 24 using the overlapping fastening members 33 and the connecting screws 34 as shown in FIG. 2. The tie rods 50 are then inserted into the interior support columns 30 and secured in place using the nut 54 into which the tie rod 50 is threaded using the bolt head 54. At each corner of the building, a corner brace 23 (see FIG. 1) is then fastened in place using screws or other appropriate fastening means.

Figure 12:
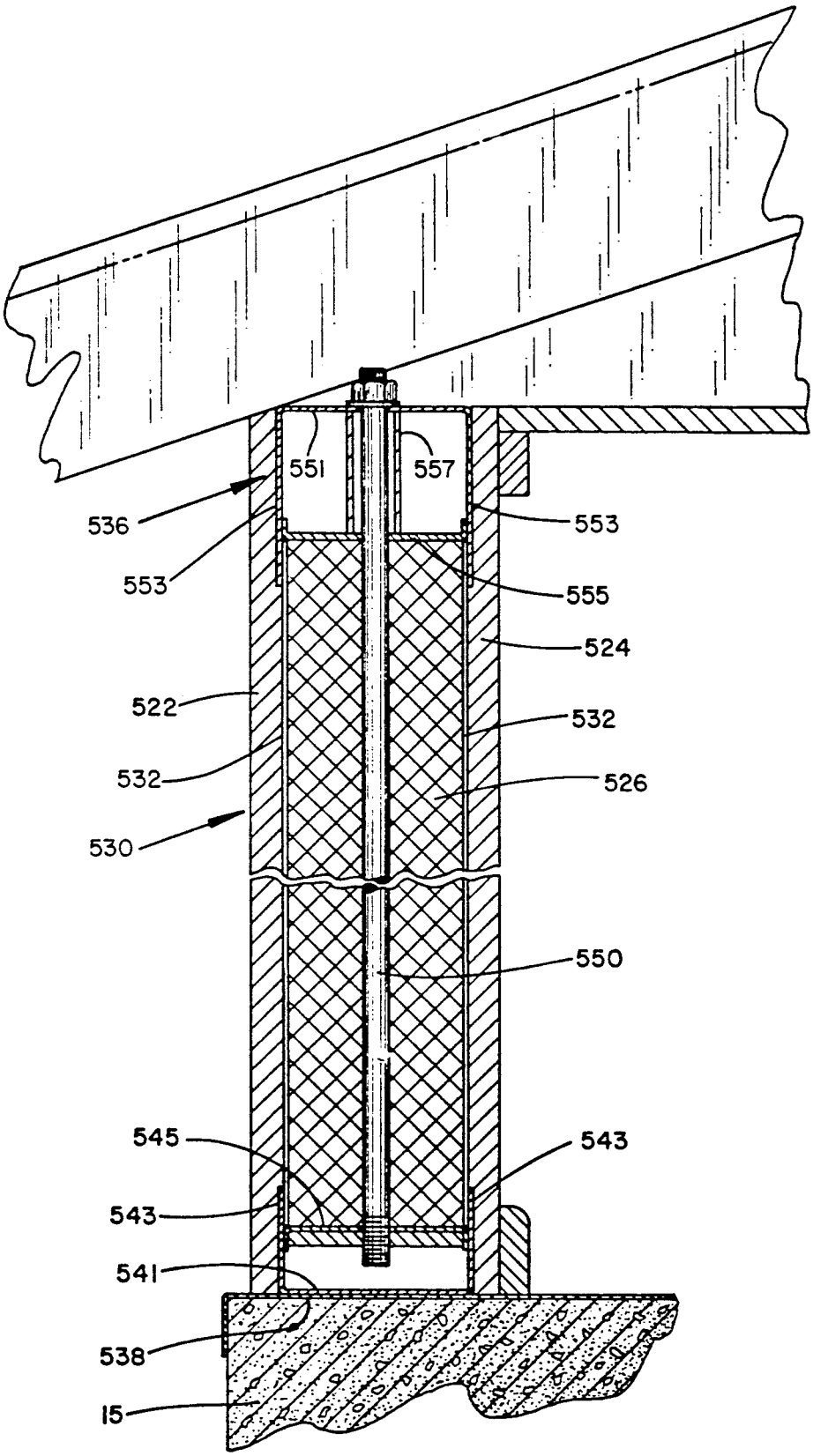
FIG. 12 is a detailed view of an alternate embodiment of the interior support column of the present invention.

FIG. 12 shows an alternate embodiment of the present invention showing modified top and bottom channel plates as well modified means for holding the tie rod in place. FIG. 12 is a view similar to FIG. 2 showing the interior support column 530. This interior support column 530 is used in a building element 20 as shown in FIG. 1 in lieu of the interior support column 30. The interior support column 530 is comprised of four side walls 532 forming a hollow, rectangular cavity which is subsequently provided with styrofoam 526. An outside wall surface 522 and an inside wall surface 524 are also provided. This embodiment, however, utilizes alternate top and bottom channel plates from those shown in FIGS. 1 and 2.

Figure 13:
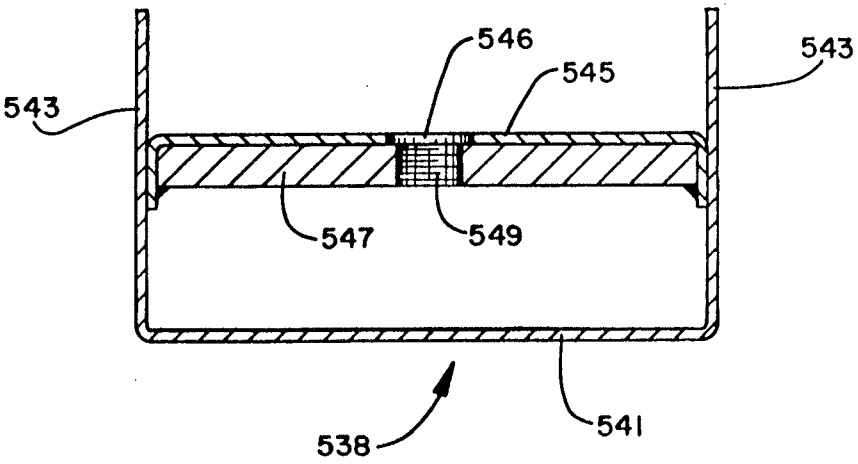
FIG. 13 is a detailed view of a modified bottom channel plate of the present invention.

The bottom channel plate 538 is shown in greater detail in FIG. 13. The bottom channel plate 538 comprises a generally U-shaped member 541 having upstanding side members 543. A bottom interior plate 545 extends across the width of the U-shaped member 541 and has a central aperture 546. A support bar 547 is joined to the bottom interior plate 545 and has a central threaded aperture 549 that is aligned with the aperture 546 in the interior plate 545. The central threaded aperture 549 receives the threaded end of the tie rod 550 as shown in FIG. 12.

Figure 14:
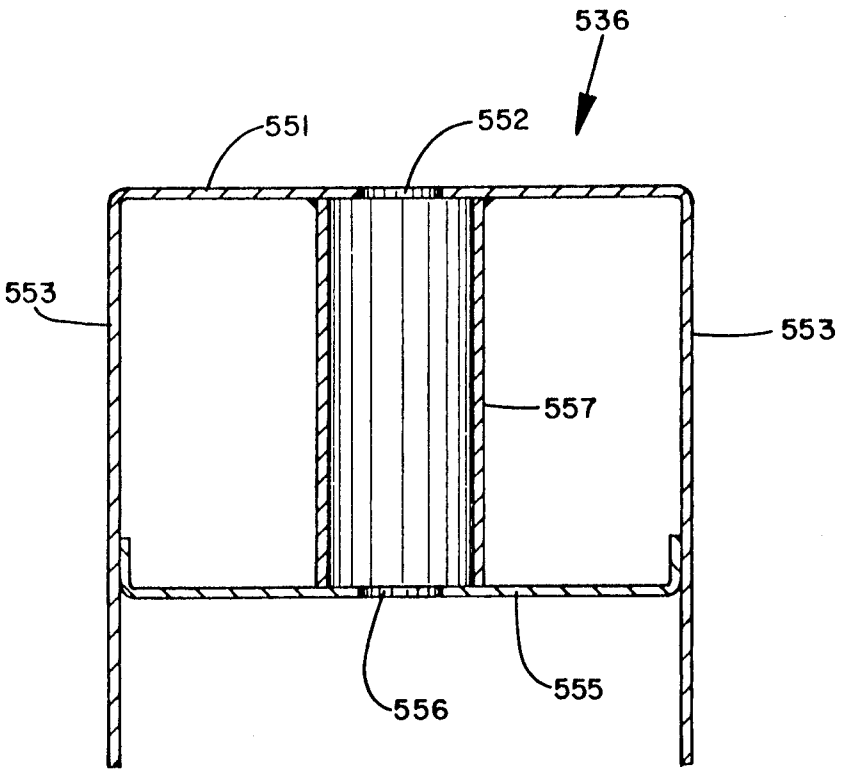
FIG. 14 is a detailed view of a modified top channel plate of the present invention.

FIG. 14 shows in detail the top channel plate 536. The top channel plate 536 comprises a generally inverted U-shaped member 551 having depending side members 553 and an aperture 552 generally in the center thereof. A top interior plate 555 spans the interior width of the inverted U-shaped member 551 and has an aperture 556 generally in the center thereof. A top tube spacer 557 is provided between the top interior plate 555 and the top of the inverted U-shaped member 551. As shown in FIG. 12, this top channel plate 536 receives the top portion of the tie rod 550 and the top tube spacer 557 provides the necessary support to hold the tie rod 550 in place when it is screwed into the threaded aperture 549 in the bottom channel plate.

Figure 15:
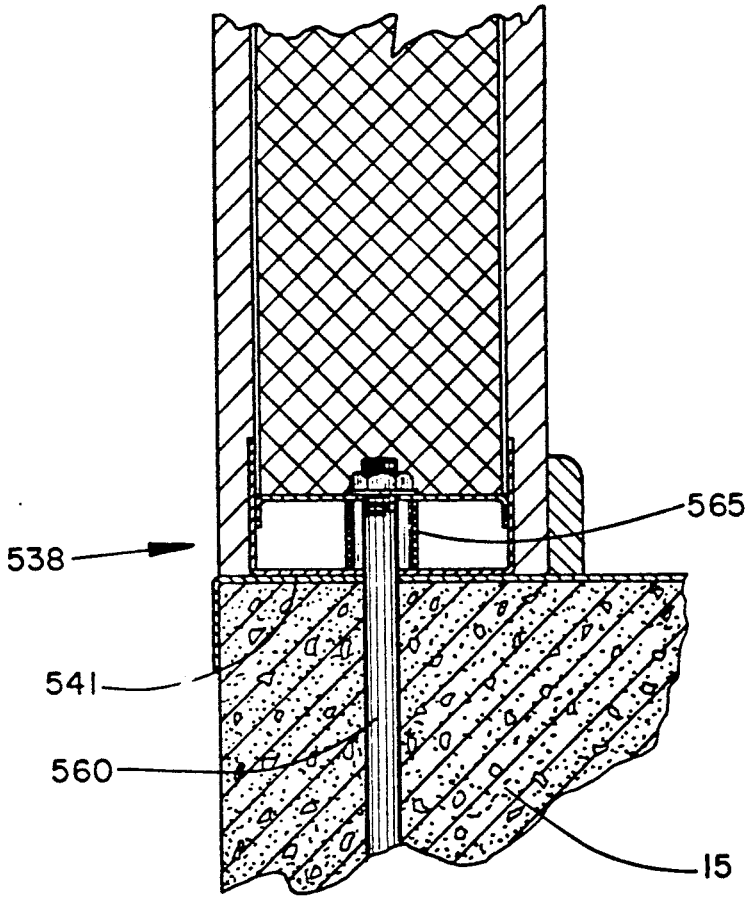
FIG. 15 is a detailed view showing an alternate embodiment of the bottom channel plate fastened to the floor of a building.

FIG. 15 shows in an exploded view an alternate embodiment for securing the bottom channel plate 538 to the cement floor 15, similar to the configuration shown in FIG. 4. A bottom tube spacer 565 provides the necessary support for the bolt 560 that fastens the bottom channel plate 538 to the cement floor 15.

Figure 16:
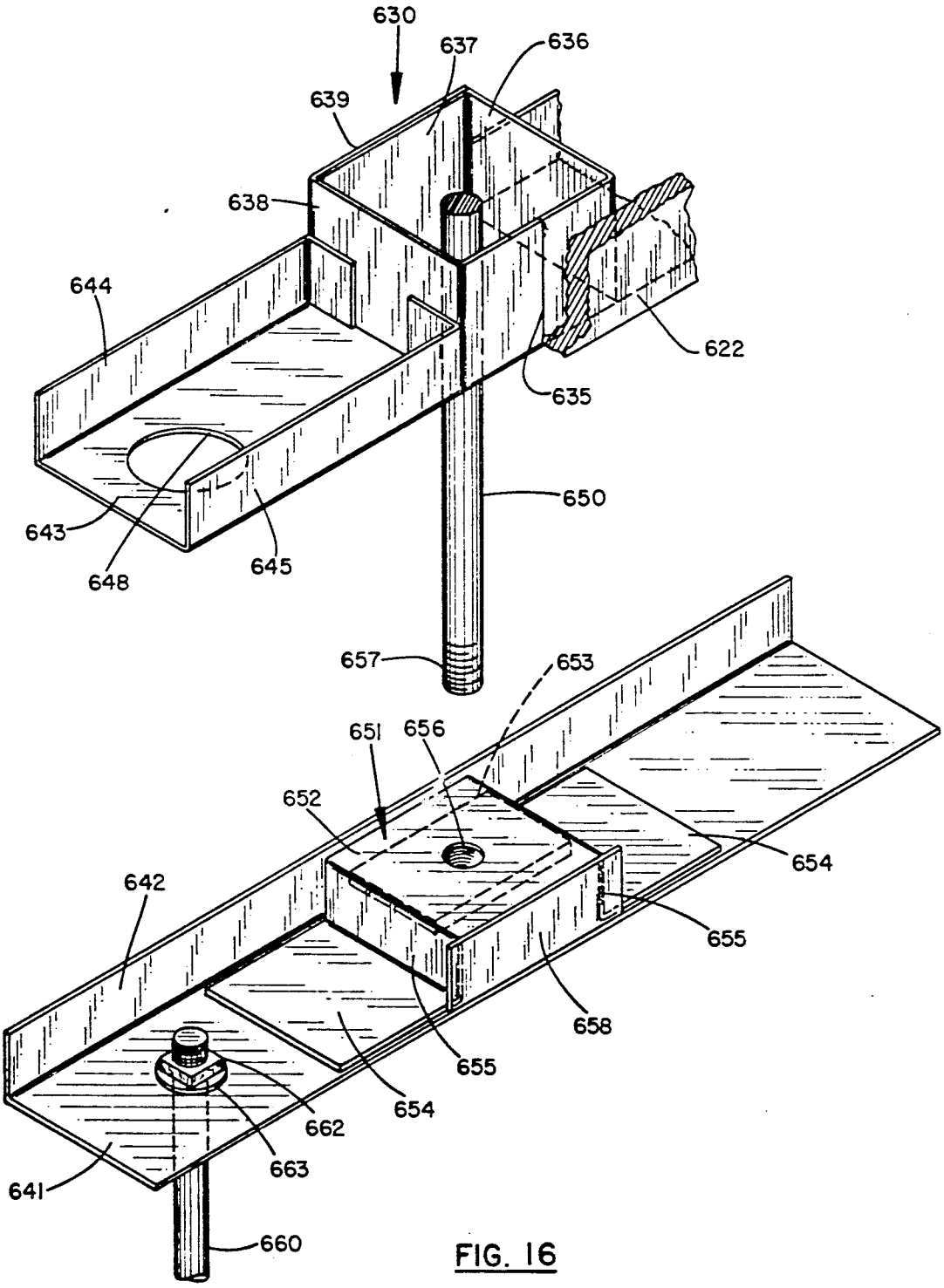
FIG. 16 is a detailed exploded view of another alternate embodiment of the present invention.

Another alternate embodiment of the present invention is shown in FIG. 16. The support column 630 (similar to the support column 30 shown in FIGS. 1 and 2) comprises a two piece split column assembly. The first piece 636 is a generally C-shaped section that abuts with the second piece 638 along an abutment line 635. The other ends of these two pieces are overlapping legs 637 and 639. The outside wall surface 622 is then attached directly to the support column 630.

The support column 630 is mounted on the bottom channel plate 641 which has also been modified. The bottom channel plate 641 is a generally L-shaped member which has an upstanding sidewall 642. The bottom channel plate 641 is secured to the floor of the building foundation by a bolt 660 which is disposed through an aperture in the bottom plate 641 and held in place by a nut 662 and washer 663 assembly.

A bottom overplate 643 is provided that is a generally U-shaped member having upstanding sidewalls 644 and 645 and overlies the bottom plate 641 when the parts are assembled. The bottom overplate 643 is provided with a generally oval shaped aperture 648 which allows the nut 662 and washer 663 assembly to extend above the plane of the bottom plate 641 for access and tightening.

The tie rod 650 extends down generally the center of the support column 630 and is secured to the bottom plate 641 by means of a tie rod mounting assembly 651. The tie rod mounting assembly 651 comprises a generally rectangular plate 652 raised above the lower level of the bottom plate 641. Each end of the rectangular plate 652 is connected to mounting legs 654 which join the rectangular plate 652 to the bottom plate 641 by any suitable means, such as welding. The rectangular plate 652 is raised above the level of the mountings legs 654 by means of webs 655. A support bar 653 is joined to the underside of the rectangular plate 652 and both the rectangular plate 652 and the support bar 653 have threaded apertures 656 generally in the center thereof to receive the threaded end 657 of the tie rod 650. The one side of the space underneath the rectangular plate 652 is closed off by a cover member 658 which provides a mounting surface for the lower end of the outside wall surface 622. The opposite side of the space under the rectangular plate is closed off by the upstanding sidewall 642 on the bottom plate 641.

The upper end of the split support column 630 is connected to an upper channel plate which can be in the form of the upper channel plate as shown in FIG. 14.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A wall for a building comprising:

a) a top channel plate, b) a bottom channel plate, c) a load bearing interior support column connecting the top channel plate to the bottom channel plate, the interior support column providing means for joining said wall to an adjoining wall of said building when the building is assembled, d) a non-load bearing outside wall surface and a non-load bearing inside wall surface attached to the top channel plate, the bottom channel plate and the interior support column, e) the interior support column comprising a hollow body having a generally rectangular cross-section, f) a tie rod connecting the top channel plate to the bottom channel plate, said tie rod positioned within the interior support column, g) insulating material disposed within a cavity formed by the outside wall surface, the inside wall surface, the top channel plate, the bottom channel plate and the interior support column, and h) insulating material disposed within the hollow body of each interior support column.

2. The wall for a building of claim 1 wherein the top channel plate is generally W-shaped.

3. The wall for a building of claim 2 wherein the outer wall surface and the inner wall surface are each attached to an outer end of the top channel plate.

4. The wall for a building of claim 2 wherein the interior support column is connected to an intermediate portion of the top channel plate.

5. The wall for a building of claim 4 wherein the interior support column is connected to the top channel plate by fastening means.

6. The wall for a building of claim 1 wherein the bottom channel plate is generally inverted W-shaped.

7. The wall for a building of claim 6 wherein the outer wall surface and the inner wall surface each rest on an end flange of the bottom channel plate.

8. The wall for a building of claim 6 wherein the interior support column is connected to an intermediate portion of the bottom channel plate.

9. The wall for a building of claim 8 wherein each interior support column is connected to the bottom channel by a fastening means.

10. The wall for a building of claim 8 wherein the top channel plate is generally W-shaped.

11. The wall for a building of claim 10 wherein the outer wall surface and the inner wall surface are each attached to an outer end of the top channel plate.

12. The wall for a building of claim 10 wherein the interior support column is connected to an intermediate portion of the top channel plate.

13. The wall for a building of claim 12 wherein the interior support column is connected to the top channel plate by fastening means.

14. The wall for a building of claim 1 wherein the tie rod includes a head supported by the top channel plate and a nut supported by the bottom channel plate.

15. The wall for a building of claim 1 wherein the insulating material is of the group consisting of expanded polystyrene, extruded polystyrene, polyisocyanurate, polyurethane, fiberglass and Celotex®.

16. The wall for a building of claim 1 further including a vertical attachment member.

17. The wall for a building of claim 16 wherein the vertical attachment member is generally C-shaped.

18. The wall for a building of claim 16 wherein the vertical attachment member is located at generally the midpoint of the length of the building element.

19. The wall for a building of claim 16 further comprising means for attaching the vertical attachment member to the top channel plate.

20. The wall for a building of claim 19 wherein the means for attaching are pins.

21. The wall for a building of claim 16 further including means for attaching the vertical attachment member to the bottom channel plate.

22. The wall for a building of claim 21 wherein the means for attaching are pins.

23. The wall for a building of claim 1 further including means for securing the bottom channel plate to the floor of a building.

24. The wall for a building of claim 23 wherein the means for securing is a bolt.

25. The wall for a building of claim 24 wherein the bolt passes through an aperture in a central area of the bottom channel plate.

26. The wall for a building of claim 24 further including means for providing support to the central area of the bottom channel plate.

27. The wall for a building of claim 26 wherein the means for providing support is a solid bar.

28. A wall for a building for use as an exterior wall module comprising:

a) a top channel plate,
b) a bottom channel plate,
c) a load bearing interior support column connecting the top channel plate to the bottom channel plate, the interior support column providing means for joining said wall to an adjoining wall of said building when the building is assembled,
d) a non-load bearing outside wall surface and a non-load bearing inside wall surface attached to the top channel plate, the bottom channel plate and the interior support column,
e) the interior support column comprising a hollow body having a generally rectangular cross-section,
f) a tie rod connecting the top channel plate to the bottom channel plate, said tie rod positioned within the interior support column,
g) insulating material disposed within a cavity formed by the outside wall surface, the inside wall surface, the top channel plate, the bottom channel plate and the interior support column,
h) insulating material disposed within the hollow body of each interior support column, and
i) the outside wall surface is material selected from the group consisting of stucco, masonite, wood siding and brick.

29. The wall for a building of claim 28 wherein the inside wall surface is material selected from the group consisting of gypsum board and fiber cement.

30. A wall for a building for use as an exterior window module comprising:

a) a top channel plate,
b) a bottom channel plate,
c) a load bearing interior support column connecting the top channel plate to the bottom channel plate, the interior support column providing means for joining said wall to an adjoining wall of said building when the building is assembled,
d) a non-load bearing outside wall surface and a non-load bearing inside wall surface attached to the top channel plate, the bottom channel plate and the interior support column,
e) the interior support column comprising a hollow body having a generally rectangular cross-section,
f) a tie rod connecting the top channel plate to the bottom channel plate, said tie rod positioned within the interior support column,
g) insulating material disposed within a cavity formed by the outside wall surface, the inside wall surface, the top channel plate, the bottom channel plate and the interior support column,
h) insulating material disposed within the hollow body of each interior support column, and
i) the outside wall surface and the inside wall surface each comprising an upper wall surface panel and a lower wall surface panel defining a window opening.

31. The wall for a building of claim 30 wherein the outside wall surface is material selected from the group consisting of stucco, masonite, wood siding and brick.

32. The wall for a building of claim 31 wherein the inside wall surface is material selected from the group consisting of gypsum board and fiber cement.

33. A wall for a building for use as an exterior door module comprising:

a) a top channel plate,
b) a bottom channel plate,
c) a load bearing interior support column connecting the top channel plate to the bottom channel plate, the interior support column providing means for joining said wall to an adjoining wall of said building when the building is assembled,
d) a non-load bearing outside wall surface and a non-load bearing inside wall surface attached to the top channel plate, the bottom channel plate and the interior support column,
e) the interior support column comprising a hollow body having a generally rectangular cross-section,
f) a tie rod connecting the top channel plate to the bottom channel plate, said tie rod positioned within the interior support column,
g) insulating material disposed within a cavity formed by the outside wall surface, the inside wall surface, the top channel plate, the bottom channel plate and the interior support column,
h) insulating material disposed within the hollow body of each interior support column, and
i) the outside wall surface and the inside wall surface each comprising an upper wall surface panel defining a door opening.

34. The wall for a building of claim 33 wherein the outside wall surface is material selected from the group consisting of stucco, masonite, wood siding and brick.

35. The wall for a building of claim 33 wherein the inside wall surface is material selected from the group consisting of gypsum board and fiber cement.

36. The wall for a building of claim 33 further including a door frame support for mounting a door in the exterior door module.

37. A wall for a building comprising:

a) a top channel plate comprising a generally inverted U-shaped member and an interior plate, both the U-shaped member and the interior plate each having an aperture for receiving the tie rod therethrough, and a top tube spacer mounted between the U-shaped member and the interior plate, b) a bottom channel plate comprising a generally U-shaped member and a bottom interior plate, the bottom interior plate including a support bar joined thereto, the bottom interior plate and the support bar each having an aperture for receiving the tie rod therethrough, c) an interior support column connecting the top channel plate to the bottom channel plate, the interior support column providing means for joining said wall to an adjoining wall of said building when the building is assembled, d) an outside wall surface and an inside wall surface attached to the top channel plate, the bottom channel plate and the interior support column, e) the interior support column comprising a hollow body having a generally rectangular cross-section, f) a tie rod connecting the to channel plate to the bottom channel plate, said tie rod positioned within the interior support column, g) insulating material disposed within a cavity formed by the outside wall surface, the inside wall surface, the top channel plate, the bottom channel plate and the interior support column, and h) insulating material disposed within the hollow body of each interior support column.

38. The wall for a building of claim 37 wherein the outer wall surface and the inner wall surface are each attached to a side wall of the top channel plate.

39. The wall for a building of claim 37 wherein the interior support column is connected to the top channel plate.

40. The wall for a building of claim 39 wherein the interior support column is connected to the top channel plate by fastening means.

41. The wall for a building of claim 37 wherein the outer wall surface and the inner wall surface are each attached to a side wall of the bottom channel plate.

42. The wall for a building of claim 37 wherein the interior support column is connected to the bottom channel plate.

43. The wall for a building of claim 42 wherein the interior support column is connected to the bottom channel by a fastening means.

44. The wall for a building of claim 37 wherein the tie rod includes a head supported by the top channel plate and a nut supported by the bottom channel plate.

45. The wall for a building of claim 37 wherein the insulating material is of the group consisting of expanded polystyrene, extruded polystyrene, polyisocyanurate, polyurethane, fiberglass and Celotex®.

46. The wall for a building of claim 37 further including a vertical attachment member.

47. The wall for a building of claim 46 wherein the vertical attachment member is generally C-shaped.

48. The wall for a building of claim 46 wherein the vertical attachment member is located at generally the midpoint of the length of the building element.

49. The wall for a building of claim 46 further comprising means for attaching the vertical attachment member to the top channel plate.

50. The wall for a building of claim 49 wherein the means for attaching are pins.

51. The wall for a building of claim 46 further including means for attaching the vertical attachment member to the bottom channel plate.

52. The wall for a building of claim 51 wherein the means for attaching are pins.

53. The wall for a building of claim 37 further including means for securing the bottom channel plate to the floor of a building.

54. The wall for a building of claim 53 wherein the means for securing is a bolt.

55. The wall for a building of claim 54 wherein the bolt passes through an aperture in a central area of the bottom channel plate.

56. The wall for a building of claim 55 further including means for providing support to the central area of the bottom channel plate.

57. The wall for a building of claim 56 wherein the means for providing support is a bottom tube spacer.

58. A wall for a building comprising:

a) a top channel plate comprising a generally inverted U-shaped member and an interior plate, both the U-shaped member and the interior plate each having an aperture for receiving the tie rod therethrough, and a top tube spacer mounted between the U-shaped member and the interior plate, b) a bottom channel plate comprising a generally L-shaped member having an upstanding sidewall, a generally U-shaped bottom overplate joined to the L-shaped member and a tie rod mounting assembly joined to the L-shaped member, c) a load bearing interior support column connecting the top channel pla to the bottom channel plate, the interior support column providing means for joining said wall to an adjoining wall of said building when the building is assembled, d) a non-load bearing outside wall surface and a non-load bearing inside wall surface attached to the top channel plate, the bottom channel plate and the interior support column, e) the interior support column comprising a hollow body having a generally rectangular cross-section and formed as a two piece split assembly with overlapping legs, f) a tie rod connecting the top channel plate to the bottom channel plate, said tie rod positioned within the interior support column, g) insulating material disposed within a cavity formed by the outside wall surface, the inside wall surface, the top channel plate, the bottom channel plate and the interior support column, and h) insulating material disposed within the hollow body of each interior support column.

59. The wall for a building of claim 58 wherein the tie rod mounting assembly comprises a generally rectangular plate raised above the level of the bottom plate by means of webs and a support bar joined to the rectangular late, both the rectangular plate and the support bar having an aperture therein for receiving the tie rod.

60. The wall for a building of claim 58 wherein the outer wall surface and the inner wall surface are each attached to a side wall of the top channel plate.

61. The wall for a building of claim 58 wherein the interior support column is connected to the top channel plate.

62. The wall for a building of claim 61 wherein the interior support column is connected to the top channel plate by fastening means.

63. The wall for a building of claim 58 wherein the outer wall surface and the inner wall surface are each attached to a side wall of the bottom channel plate.

64. The wall for a building of claim 58 wherein the interior support column is connected to the bottom channel plate.

65. The wall for a building of claim 64 wherein the interior support claim is connected to the bottom channel by a fastening means.

66. The wall for a building of claim 58 wherein the tie rod includes a head supported by the top channel plate and a nut supported by the bottom channel plate.

67. The wall for a building of claim 58 wherein the insulating material is of the group consisting of expanded polystyrene, extruded polystyrene, polyisocyanurate, polyurethane, fiberglass and Celotex®.

68. The wall for a building of claim 58 further including means for securing the bottom channel plate to the floor of a building.

69. The wall for a building of claim 68 wherein the means for securing is a bolt.

70. The wall for a building of claim 69 wherein the bolt passes through an aperture in the bottom channel plate and an oval shaped aperture is provided in the bottom overplate to receive the bolt.

* * * * *